United States Patent [19]

Moeneclaey et al.

[11] Patent Number: 4,840,203

[45] Date of Patent: Jun. 20, 1989

[54] PROCESS FOR CLAMPING, FASTENING AND PRESENTATION OF WEFT THREADS IN GRIPPER WEAVING LOOMS AND DEVICE USED TO THIS END

[75] Inventors: Denis Moeneclaey, Roeselare; Remi Lagache, Zillebeke-Ieper; Johnny Victoor, Langemark; Lucien Coopman, Zonnebeke, all of Belgium

[73] Assignee: Picanol N.V., Ieper, Belgium

[21] Appl. No.: 33,739

[22] Filed: Apr. 3, 1987

[30] Foreign Application Priority Data

Apr. 3, 1986 [NL] Netherlands ..... 8600857

[51] Int. Cl.[4] ..... D03D 47/34

[52] U.S. Cl. ..... 139/453

[58] Field of Search ..... 139/453

[56] References Cited

U.S. PATENT DOCUMENTS

| | | | |
|---|---|---|---|
| 3,299,909 | 1/1967 | Golobart | 139/435 |
| 3,536,105 | 10/1970 | Piccoli | 139/453 |
| 3,587,665 | 6/1971 | Monge | 139/453 |
| 4,143,684 | 3/1979 | Lindenmuller et al. | 139/453 |
| 4,540,028 | 9/1985 | Gehring et al. | 139/453 |

FOREIGN PATENT DOCUMENTS 2515609 10/1976 Fed. Rep. of Germany .

*Primary Examiner*—Henry S. Jaudon

*Attorney, Agent, or Firm*—Bacon & Thomas

[57] ABSTRACT

Apparatus for clamping, holding and presenting weft threads in a weaving loom is disclosed having: a movable clamp for each weft thread which keeps the corresponding weft threads clamped at their thread ends; thread guiding devices guiding of the weft threads from a supply to the corresponding clamp; and a driving and control mechanism for bringing a clamp successively into three positions for inserting the selected weft thread. The first position of the clamp is a storage position; the second position is located such that the weft thread between the clamp and the thread guiding devices is in the path of a gripper; and in the third position the clamp is located on the weft side near the cloth edge adjacent to the fell. Hooks fastened to the reed bring the insert weft thread back into the clamp during the beating movement of the reed. The hooks also act as a guiding element during the presentation of the weft thread to the gripper.

9 Claims, 6 Drawing Sheets

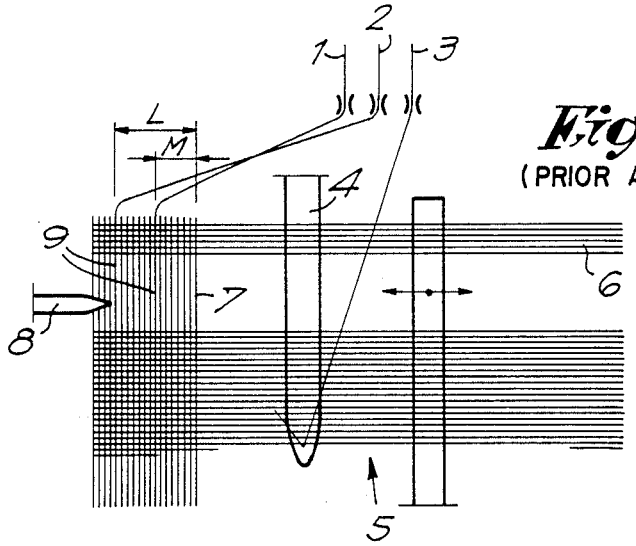
Fig. 1
(PRIOR ART)
Fig. 2
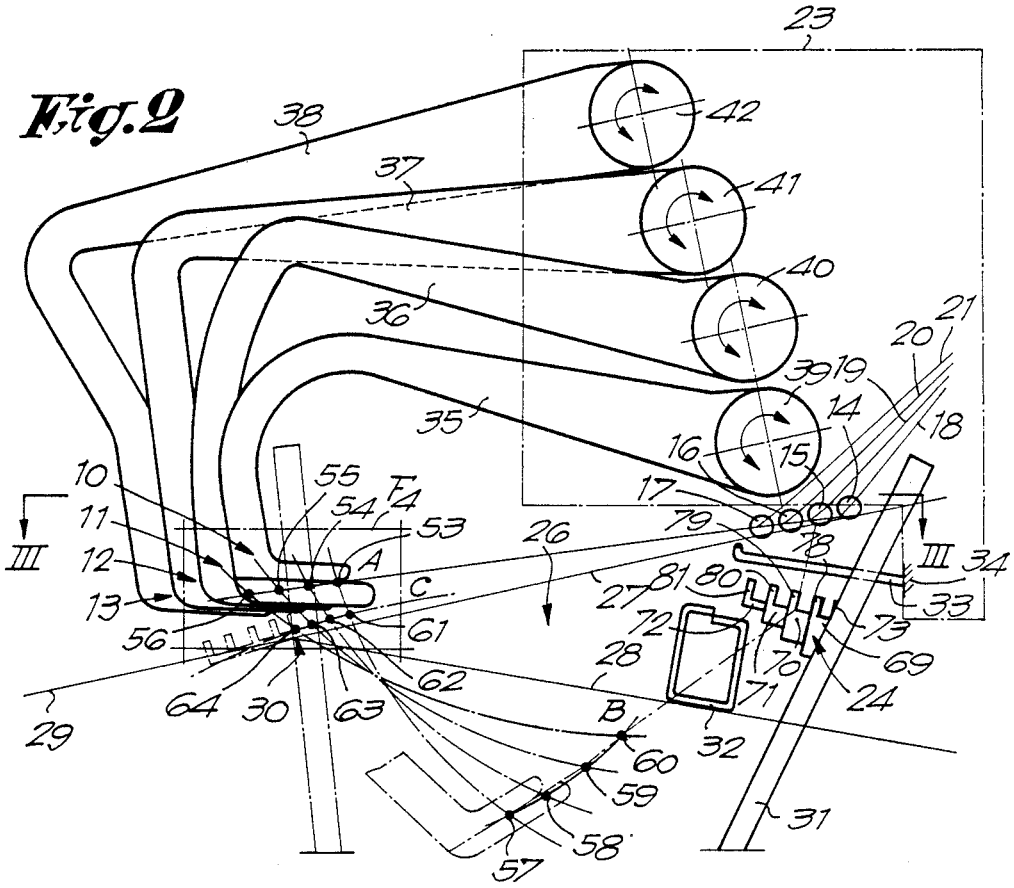

PROCESS FOR CLAMPING, FASTENING AND PRESENTATION OF WEFT THREADS IN GRIPPER WEAVING LOOMS AND DEVICE USED TO THIS END

BACKGROUND OF THE INVENTION

The present invention concerns an apparatus for clamping, holding and presenting weft threads in gripper weaving looms.

More particularly, the invention concerns an apparatus designed for weaving several weft threads without waste on the weft insertion side.

It is known that by weaving several weft threads in gripper weaving looms, the different threads are respectively held after their last insertion by means of separate waste threads located near the usual chain threads. Each weft thread is held this way by the waste threads to a moment just before the insertion of the following weft thread whereby the weft threads are kept essentially perpendicular to the edge of the woven cloth. The waste threads, as well as the ends of the weft threads held this way are cut off at some distance behind the fell, as waste of the woven cloth. Quite obviously a relatively large quantity of weft threads, as well as waste threads, are lost this way as waste.

A known solution for this problem comprises the method described in the patent DOS No. 25 15 609, whereby the weft threads are immediately cut off after the insertion in the shed and are stored in an adequate manner by means of a pneumatic device until the insertion of the following weft thread, whereby no waste threads are required. This method, as well as the device used to this end, has the disadvantage that a pneumatic device or a connection to a compressed air source is required.

Another solution for weaving without waste is described in U.S. Pat. No. 4,143,684 whereby the weft threads are kept taut at the presentation to the gripper between thread eyelets and a common device for holding the thread ends, whereby the latter consists of a suction device. This way, only one thread is kept in the suction device and is presented to the gripper while the other thread is still connected with the edge of the cloth. This device has the disadvantage that it is only suitable for working with a maximum of two weft threads.

Another disadvantage is that these two weft threads must be alternatively presented, without the possibility of introducing the same weft thread two or more times successively into the shed.

SUMMARY OF THE INVENTION

The present invention is an apparatus for weaving without waste on the side of weft insertion, whereby the aforesaid disadvatages no longer exist. To this end, the invention proposes a mechanical device whereby it is possible to work with several weft threads and with any weaving pattern.

Moreover, the invention has the advantage that the free weft end to the gripper may be kept to an identical or a minimum length for the various weft threads.

According to a further advantage of the invention, the different weft threads can be presented to the gripper in relationship to the axis of the shed at a very short distance from the edge of the woven cloth, whereby it is consequently possible to work with a shorter run of the gripper outside the woven cloth. This presentation may preferably occur perpendicularly to the aforesaid axis. It is, however, quite possible to carry out this presentation in a direction parallel to the axis. In the case of perpendicular presentation, it is also possible to use a smaller gripper.

Still another advantage of the invention is that the moments of presentation and cutting off of the weft threads are independent of the various weft threads.

Still another advantage is that the stress applied to the various weft threads for their presentation to the gripper can be set independently for each weft thread in such a way that each weft thread is presented with an optimum stress to the gripper.

Still another advantage of the invention is that the apparatus may comprise only a small number of moving parts, while no special needles are necessary in order to bring the selected weft thread into the path of the gripper. This offers also the advantage that, if fabric of different width must be woven, the apparatus can be easily moved on the weaving loom in accordance with the width of the woven cloth.

Still another advantage of the invention is that the apparatus makes it possible, in the case of weft thread breakage, to immediately cancel the presentation of the threads and that it is consequently no longer necessary to stop the weaving loom for less than one weaving cycle.

The clamping, holding and presenting of weft threads for gripper weaving looms in accordance with the invention as characterized by the aforesaid advantages, implies essentially that each end of the weft threads is kept motionless by means of special movable clamps which are located in a first position for the insertion of a selected weft thread. After the selection of the weft thread, the following successive operations take place: the presentation of the selected weft thread to the gripper; the picking up of the weft thread out of the corresponding clamp by the gripper by bringing the latter into the opened shed; the introduction of the corresponding weft thread further into the shed; the beating-up of the introduced weft thread into the shed and bringing the weft thread into the clamp; and cutting off the weft thread introduced into the shed between the edge of the cloth and the corresonding clamp.

The device of the present invention preferably comprises the combination of: of moving clamp for each weft thread which can keep the corresponding weft threads clamped at their thread end; thread guiding devices achieving the guiding of the weft threads from their supply point to the corresponding clamp; a driving and control mechanism for bringing the clamp successively in three positions for insertion of the selected weft thread, whereby the first position is a motionless condition, the second position is located in such a way that the weft thread between the clamp and the thread guiding means can be presented in the path of the gripper and in the third position the clamp is located on the weft side near the cloth edge in the continuation of the fell; auxiliary means fastened to the reed for bringing into the clamp the last weft thread introduced into the shed at the insertion side and during the beating movement of the reed; and cutting means which are mounted on the insertion side of the woven cloth near the cloth edge. The aforesaid auxiliary means act as a guiding element by the presentation of the weft thread and also serve as a length compensating element during the presentation.

According to an alternative embodiment of the device in accordance with the invention, the driving and control mechanism brings the clamps mainly into two positions, whereby one position is a motionless condition and whereby in the other position the clamp of the selected weft thread is located on the insertion side near the cloth edge in the continuation of the fell. In this case, the aforesaid thread guiding means are moving parts in such a way that a selected weft thread can be brought in the path of the gripper by moving the corresponding thread guiding element.

BRIEF DESCRIPTION OF THE DRAWINGS

In order that the characteristics of the present invention are better understood, a preferred embodiment of the device is described hereafter by way of examples and without any limitative character with reference to the figures which are respectively:

FIG. 1 is a schematic illustration of the known method of weaving;

FIG. 2 is a partial, schematic side view of the device according to the invention;

DETAILED DESCRIPTION OF THE PREFERRED EMBODIMENTS

Figure 3:
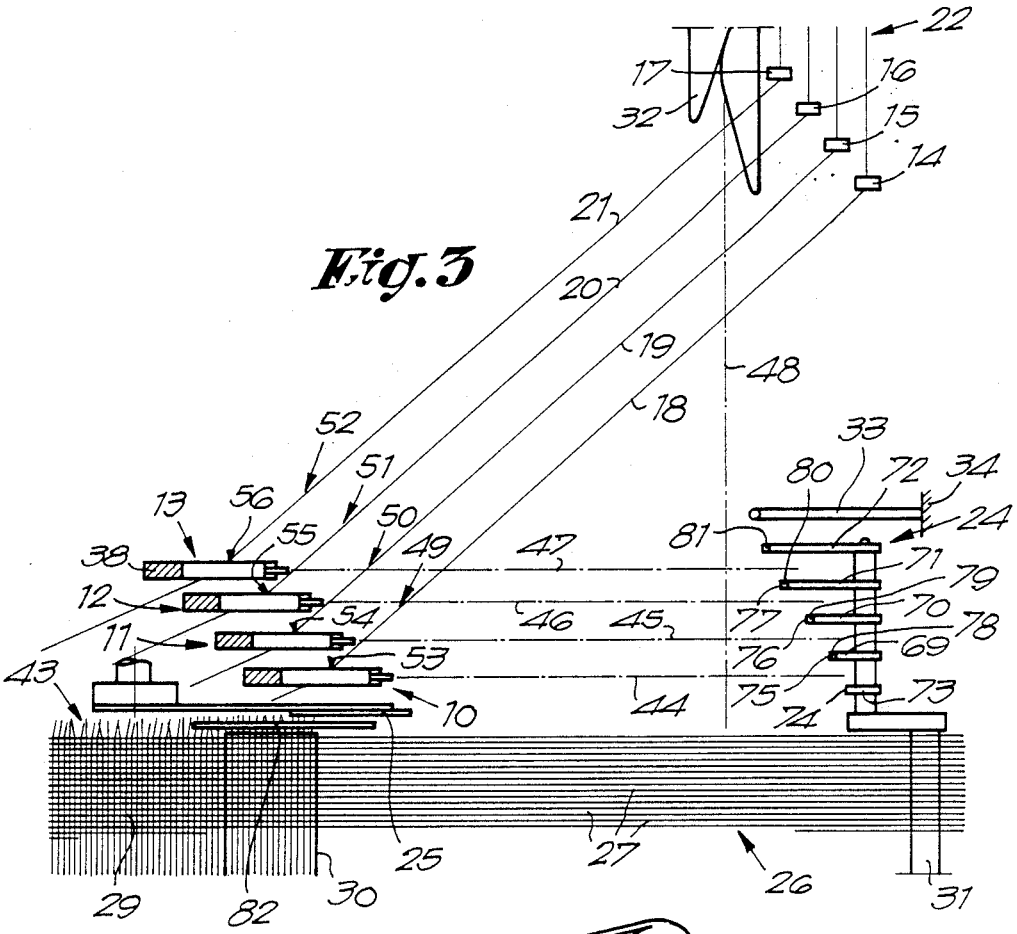
FIG. 3 is a partial cross-section taken along line III-III of FIG. 2.

FIG. 1 is a schematic top view of a known device for weaving several weft threads, respectively 1–3, whereby these weft threads are introduced in a predetermined pattern into the shed 5 by means of a gripper 4.

For holding the weft threads which are not presented to the gripper, in the present case the weft yarns 1 and 2, several waste threads 6 are used. The respective weft threads are held this way until a moment immediately before the insertion of the respective weft thread whereby they are cut off by means of a cutting off device located near the cloth edge upon their introduction into the shed.

At some distance from the fell 7 the waste threads 6 with the weft thread ends already cut off are removed by means of a cut off device 8. Quite obviously, a relatively large quantity of weaving thread composed of the waste threads 6 and of thread parts 9 held within these waste threads, as well as the thread lengths L and M, are lost as waste in this case.

The invention concerns a device whereby such waste threads 6 are not required and whereby it is possible to weave without waste.

As illustrated in FIG. 2, the device in accordance with the invention comprises several moving clamps 10 to 13; thread guiding means 14 to 17 whereby weft threads 18 to 21 are guided from their a supply point near the control mechanism to their corresponding clamps 10 to 13; a driving and control mechanism 23 for actuating the clamps 10 to 13 in an adequate manner; auxiliary means 24 for bringing the weft threads 18 to 21 after their insertion back into their respective clamps 10 to 13; and cut off means 25 for cutting off each weft thread 18 to 21 after its respective insertion.

The auxiliary means 24 are guiding elements at the presentation of the weft thread and also have a length compensating effect during this presentation.

Moreover, FIG. 2 also illustrates the shed 26, the warp threads 27 and 28, the woven cloth 29, the fell 30, the reed 31, the gripper 32 and a back bending rod 33 which may be secured to the frame 34 of the control mechanism, for instance.

The moving clamps 10–13 are rotatably mounted by means of arms 35–38 about four shafts, respectively 39 to 42 which can be driven by means of the control mechanism 23. As illustrated in FIG. 3, clamps 10–13 are mounted successively near the cloth edge 43 on the weft insertion side such that they lie, in this embodiment, in parallel planes 44–47 which are perpendicular to the movement direction 48 of the gripper 32. Quite obviously, they can also carry out converging or diverging movements according to alternative embodiments.

The clamps 10–13 can have three positions A, B and C. In the A position, the clamps 10–13 are at their highest location, whereby they are also located outside the path of a straight line connecting points BC. In this stationary position A, the thread ends 49–52 of the weft threads 18–21 are held by the clamps 10–13 respectively indicated on FIGS. 2 and 3 on points 53 to 56.

The B position of the clamps 10–13 is located under the plane of lower warp threads 28 forming the lower shed, whereby the clampings points of the clamps 10–13 are illustrated in FIG. 2 by the respective points 57 to 60.

In the third C position, the clamping places of the clamps 10–13 are located at the points 61 to 64. In this C position the clamps 10–13 are located near the continuation of the fell 30.

Figure 4:
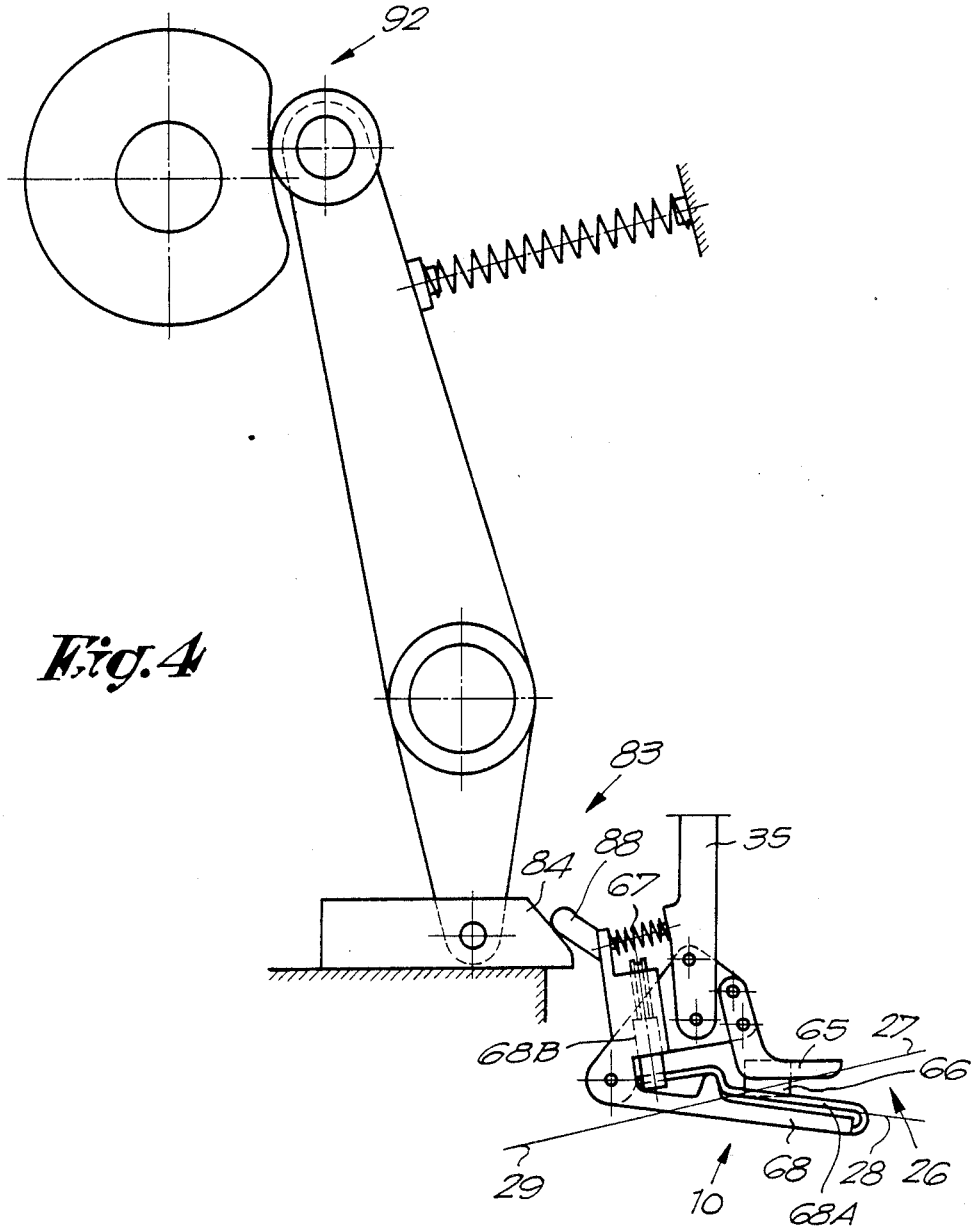
FIG. 4 is a partial side view of a clamp and a clamp opening mechanism for temporarily opening the clamps.

The clamps 10–13 per se may be any type. A practical embodiment of these clamps is illustrated in FIG. 4 and is mainly composed of an upper fixed jaw 65, equipped with a stop 66 for determining the right position of the weft threads 18–21 and a moving lower jaw 68 biased by means of a spring 67 against the fixed jaw 65. The clamps are equipped with an adjustable weft holder 68 A, which can be accurately adjusted by means of a setting device 68 B in order to adjust the desired clamping force for each weft thread 18–21.

The driving and control mechanism 23 is designed in order to bring a selected clamp from the A position to the B position and afterwards to the C position, and finally back to the A position. The construction and the working of this mechanism are described in U.S. patent application Ser. No. 33,740, filed Apr. 3, 1987.

The aforesaid thread guiding means 14 to 17 are preferably composed of thread eyelets which are fastened near the shed 26 and preferably near the corresponding hooks 78–81 when the reed 31 is in its most retracted position. To this end, the thread eyelets may be mounted on the frame of the driving and control mechanism. The aforesaid auxiliary means 24 designed for bringing the weft threads introduced into the shed 26 during the beating movement of the reed 31 into the corresponding clamps are composed, in the illustrated embodiment, of four hook elements 69 to 72 and one thread stop 73 that are all preferably secured to the reed 31 in such a way that the hook elements 69–72 can move between the respective clamps 10–13 at the beating movement of the reed.

The hook, elements 69–72 extend successively further away from the plane of the reed 31 in a direction away from the edge of the cloth and as close as possible to the gripper 32. The positions of the hook elements 69–72 correlate with the clamping points 57–60 to position the respective weft thread in the path of gripper 32.

The thread stop 73 and at least the hook elements 69, 70 and 71 may have flat front sides, respectively 74 to 77, the location of which correlates with the location of points 61–64 to reinsert the weft thread back into its respective clamp. Hooks 78 to 81 are used as length compensating elements during the presentation in such a way that the presented thread end is always kept under stress.

The thread stop 73 and the hook elements 69–72 are fixed on the reed 31 in a location such that, during the beating movement, the front sides 74–77 carry out the corresponding insertion of the weft thread into the clamp at the aforesaid points 61–64, corresponding to the C position of the clamps 10–13.

As illustrated in FIG. 3, an edge clamp 82 may also be mounted near the woven cloth 29 in a stationary or movable manner.

Figure 5:
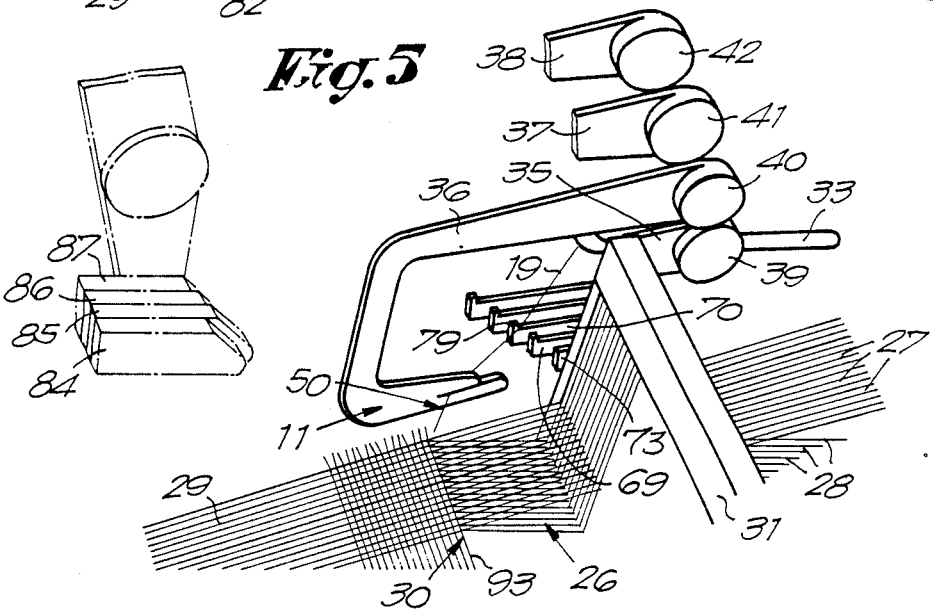
FIGS. 5–9 are partial, perspective illustrations of successive operational positions of the device in accordance with the invention.

The device in accordance with the invention may also be equipped of a clamp cleaning device illustrated in FIGS. 4 and 5 composed of a stop mechanism 83 when they are in the C position. Stop mechanism 83 has controlled stops 84 to 87 which co-operate with the stops 88 to 91 on the clamps 10–13 damp in the, in such a way that, when the controlled stops 84–87 are brought into the path of the C position, the jaws 65 and 68 can be opened whereby a pneumatic cleaning device, not illustrated on the figures, can clean the jaws 65 and 68 by means of an air jet.

The stops 84–87 are brought into the path of the clamps 10–13 by means of a common cam transmission 92 during the waiting time in the C position between the arrival and the input of the weft thread into the clamp.

The device in accordance with the invention works mainly as described hereafter with reference with the FIGS. 5 to 9. For the sake of clarity only one clamp 11 and the corresponding weft thread 19 are illustrated.

As illustrated in FIG. 5, after the weft thread 93 has been beaten-up by the reed 31, the clamp 11 which holds next weft thread to be inserted is moved by means of the driven and control mechanism 23. As the clamp 11 is moved from the A position toward the B position, the weft thread 19 is brought between the hook element 69 and 70 at the, height of point 62. At that moment a compensation of the length of the weft thread must be carried out. During the backwards movement of the reed 31 the weft thread 19 held by the clamp 11 slips over the upper side of the hook element 70 and is withdrawn by the hook 79, in such a way that the weft thread is slightly elongated between clamp 11 and the eyelet 15 and is thus kept under stress.

Figure 6:
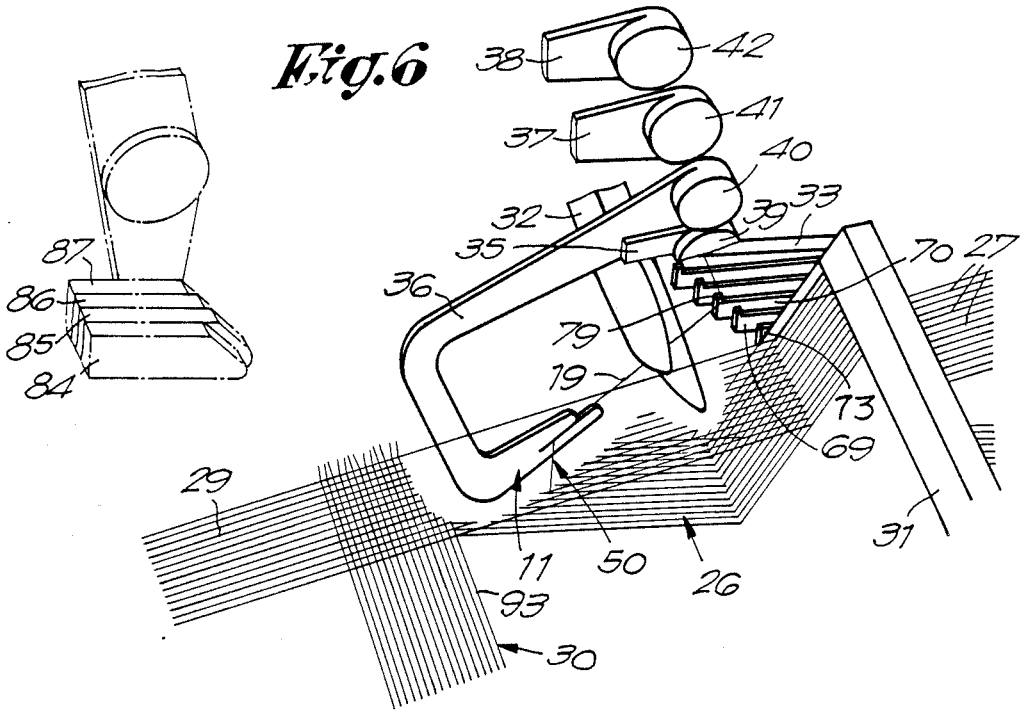

At the moment at which the clamp 11 is located in the B position, as illustrated on FIG. 6, the reed 31 is nearly in its most retracted position. In this case, the weft thread 19 is situated across the path of the gripper 32, which begins moving at this moment into the shed 26.

Figure 7:
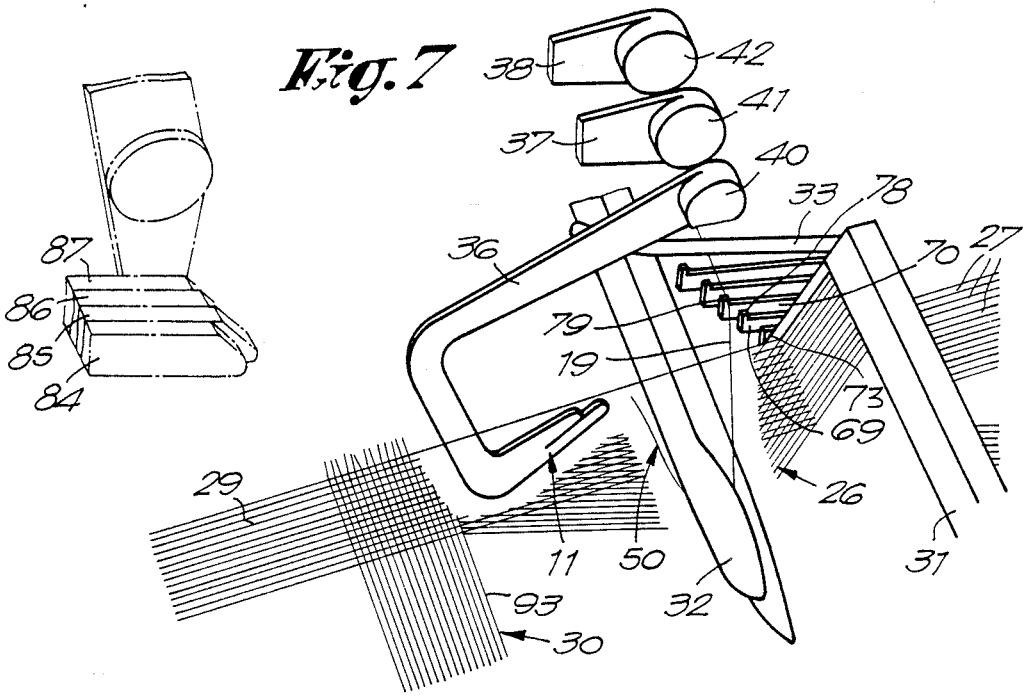

Conseqently, as illustrated in FIG. 7, the thread end 50 of the weft thread 19 is pulled out of the clamp whereby the weft thread is introduced into the shed by means of the gripper 32 over the full width of the cloth.

Consequently, the weft thread 19 is no longer in contact with the upper face of hookl element 70, but its remains located between the hooks 78 and 79, and the back bending rod 33.

Figure 8:
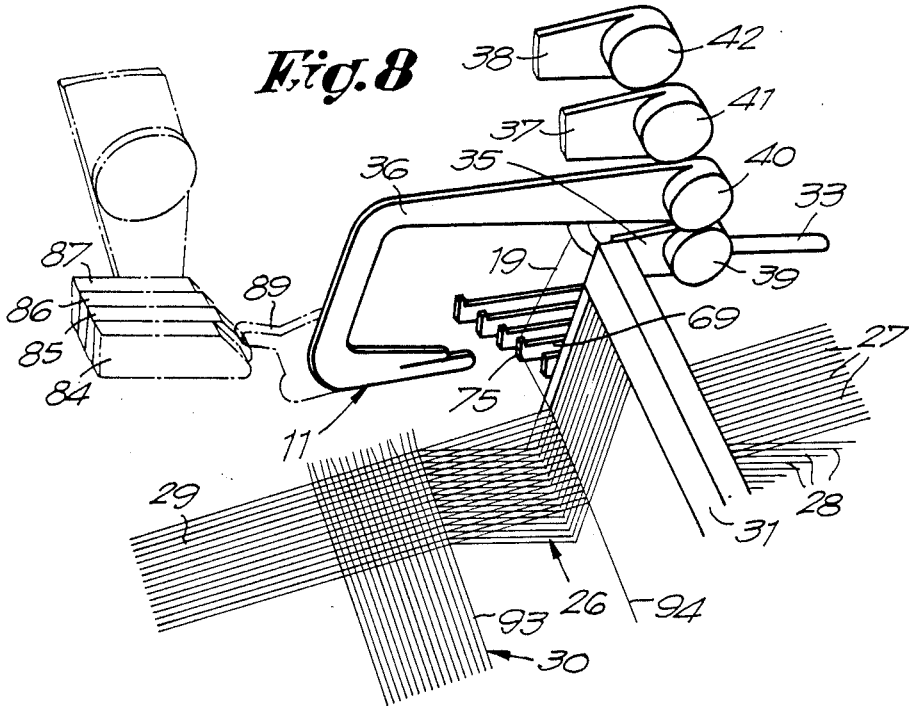

During the insertion of the weft thread 19 into the shed 26, the clamp 11 is moved from the B position to the C position and is kept in this position and as schematically illustrated in FIG. 8, the stop 85 is moved forward and cooperates with the stop 89 to open clamp 11 whereby a pneumatic cleaning device, not illustrated carries out the cleaning operation.

As illustrated in FIG. 8, as the reed 31 begins its beating movement the weft thread 19 is stretched over the front side 75 of the hook element 69 and pushed forward. In the meantime, the clamp 11 is kept in the C position and is closed again.

Figure 9:
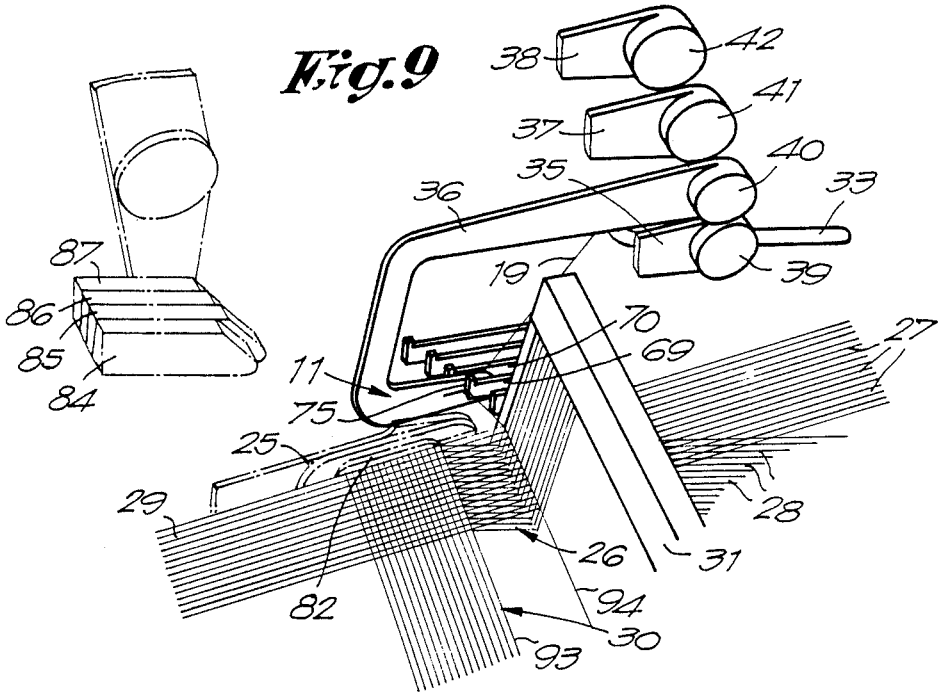
Figure 10:
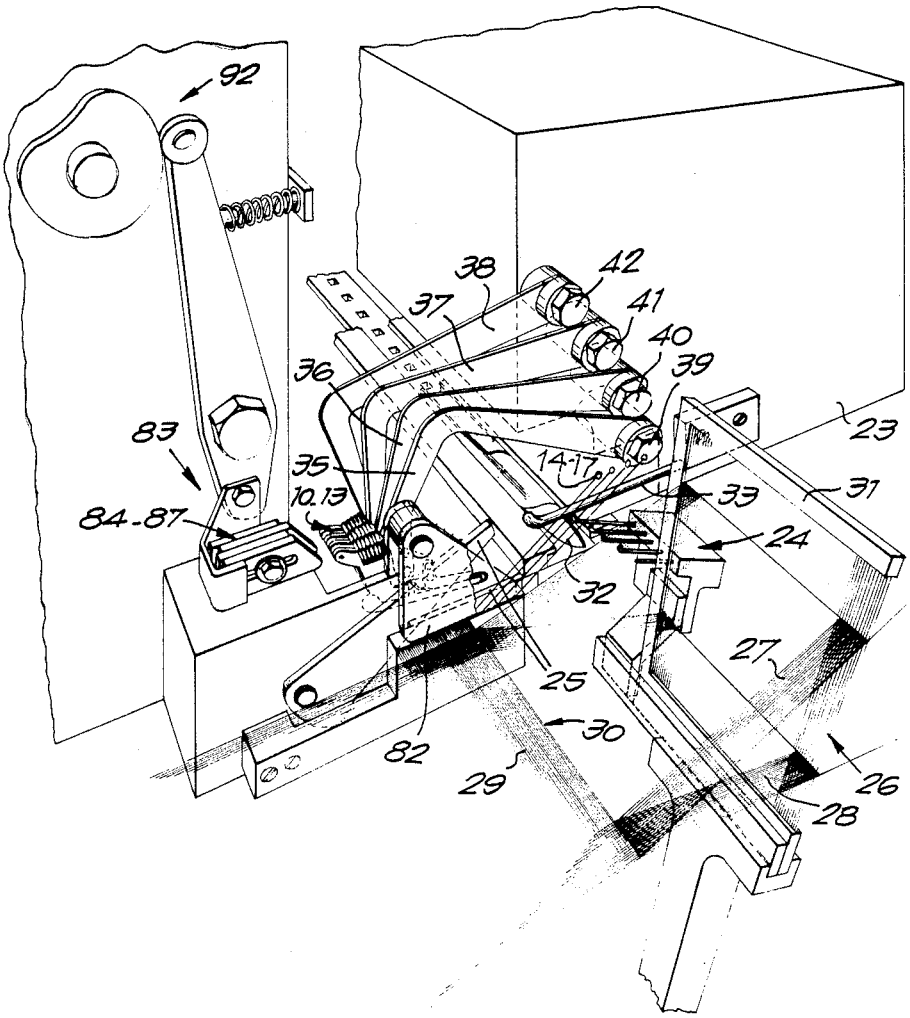
FIG. 10 is a perspective view of the device according to the invention.

As illustrated in FIG. 9, the weft thread streached over the front side 75 is inserted and held in the clamp 11 and the cutting off means 25 can be off the introduced part 94 and the clamp 11 can be moved back to its positions A. At least insertion of the weft thread and before cutting off the thread, this thread is preferably pressed in an edge clamp 82 which has the advantage that the end of the inserted thread 94 does not come back resiliently when cut off so that a smooth finish of the woven cloth 29 is achieved. Quite obviously, the edge clamp 82 must be present only at the fell 30 because at a distance from the fell 30, the weft threads are sufficiently fastened by the woven cloth 29 itself.

During two successive cycles of the same clamp, it is not necessary to retract the clamp to its A position, but it may be directly brought from the third C position to the second B position.

Quite obviously, the A, B and C positions of the clamps 10–13, the thread guiding means 14–17 and the hook elements 69–72 may be mounted according to a sutitable pattern in relationship with each other.

Quite obviously, the selection of the B position of the various clamps 10 to 13 makes it possible to minimize the weft waste of theh gripper or this waste is made the same for each weft thread 18–21 whereby a relatively uniform woven edges is achieved on the cloth side.

Quite obviously, the arms 35–38 must not necessarily be moved on parallel planes 44–47 and may follow for instance a converging movement path.

According to an alternative embodiment, the pivoting points of the arms are co-axially located instead of being displaced near each other as illustrated in FIG. 2.

The auxiliary means 24 may not be necessarily composed of one block element for each clamp 10–13, but may also be composed of a common hook element whereby the clamp 10–13 will be put in the C position and at the same distance from the cloth edge 43.

Quite obviously the clamps 10–13 may be of various types and it is quite sufficient that they are able to hold the thread ends 49–52. According to a special embodiments, the clamps 10–13 have suction devices. The clamping force of each moving clamp 10–13 can be controlled during its movement in such a way that it is minimal at any time.

Although the clamps 10–13 of the described example can be moved in order to achieve the presentation of the weft thread, the thread guiding means 14–17 may be moved to achieve the same result. The clamps 10–13 are used in this case only for achieving a movement between two positions, i.e., A and C.

The present invention is able to limit the operations to be carried out by the weaver in case of weft thread break, whereby these operations only include the removal of the broken weft thread, from the shed whereby the weft thread has been withdrawn into the shed and lost without indication, or has been indicated as being a false weft break because the weft thread is nevertheless brought into the clamp.

The present invention is by no means limited to the embodiment described and illustrated by way of examples, but this device for the presentation and the insertion into the shed of the weft threads for gripper weaving looms may be embodied with various shapes and sizes without departing from the scope of the invention.

We claim:

1. Apparatus for clampings, holding and presenting weft threads in gripper weaving looms having at least two weft threads, a for inserting the weft threads into successive sheds and a reed for beating-up the inserted weft thread, comprising:

a) plurality of movable clamps each clamp holding an end of a weft thread;

b) thread guiding means for deviating the path travelled by the weft threads from a thread supply point to a corresponding movable clamp;

c) driving and control mechanism for moving each movable clamp between three positions, wherein: in the first position the weft thread extending between the guiding means and the clamps is out of the path of travel of the gripper: in the second position the weft thread is in the path of travel of the gripper; and, in the third position the clamp is located on the insertion side of the cloth edge in the proximity of and above the fell;

d) auxiliary means attached to the reed for bringing the inserted weft thread back into the respective clamp on the insertion side during the beating movement of the reed; and e) cutting-off means for cutting off the inserted weft thread mounted along the insertion side near the cloth edge.

2. An apparatus according to claim 1, wherein thread guiding means comprise thread elyelets fastened to a frame of the loom.

3. Apparatus according to clamim 1 further comprising means to attach the movable clamps to the driving and control mechanism such that the clamps are movable in substantially parallel planes which extend substantially perpendicularly to the movement direction of the gripper.

4. Apparatus according to claim 1 wherein the auxiliarly means attached to the reed for bringing the inserted weft thread back into the corresponding clamp comprises: at least one hook element attached to the reed such that, during the beating movement of the reed, it travels along a path at the approximat height of tlhe fell thereby contacting the weft thread and urging it into the respective clamp.

5. Apparatus according to claim 4, wherein the auxiliary means comprises one hook element for each movable clamp positioned on the reed such that each hook element can move along side one of the movable clamps during the beating movement of the reed.

6. Apparatus according to claim 5 wherein the hook element extend successively further from the plane of the reed in a direction away from the edge of the cloth.

7. Apparatus according to claim 1 further comprising a back bending rod secured to frame of the loom so as to be located between the thread guiding means and the auxiliary means connected to the reed when the latter is located in its most retracted position.

8. Apparatus according to claim 1 futher comprising an edge clamp mounted adjacent the cloth edge along the weft insertion side and near the fell.

9. Apparatus according to claim 1 wherein the clamps comprise mechanical clamps which can be kept closed by spring

* * * * *